US005939372A

United States Patent [19]

Schmid et al.

[11] Patent Number: 5,939,372

[45] Date of Patent: Aug. 17, 1999

[54] USE OF DETERGENT MIXTURES FOR THE PRODUCTION OF TOILET BLOCKS

[75] Inventors: Karl Schmid, Mettmann; Andreas Syldath, Duesseldorf; Ditmar Kischkel, Monheim; Volker Bauer, Duesseldorf; Wolfgang Schmidt, Monheim; Anke Grosser, Duesseldorf, all of Germany

[73] Assignee: Henkel Kommanditgesellschaft auf Aktien, Duesseldorf, Germany

[21] Appl. No.: 08/637,632

[22] PCT Filed: Oct. 20, 1994

[86] PCT No.: PCT/EP94/03456

§ 371 Date: May 28, 1996

§ 102(e) Date: May 28, 1996

[87] PCT Pub. No.: WO95/11958

PCT Pub. Date: May 4, 1995

[30] Foreign Application Priority Data

Oct. 29, 1993 [DE] Germany ..... 43 37 032

[51] Int. Cl.[6] ..... C11D 1/10; C11D 1/48

[52] U.S. Cl. ..... 510/191; 510/192; 510/470; 510/502

[58] Field of Search ..... 510/191, 192, 510/470, 502

[56] References Cited

U.S. PATENT DOCUMENTS

| | | | |
|---|---|---|---|
| 1,985,424 | 12/1934 | Piggott | 260/124 |
| 2,016,962 | 10/1935 | Flint et al. | 260/127 |
| 2,703,798 | 3/1955 | Schwartz | 260/211 |
| 4,043,931 | 8/1977 | Jeffrey et al. | 252/93 |
| 4,534,879 | 8/1985 | Iding et al. | 252/174 |
| 4,820,449 | 4/1989 | Menke et al. | 252/544 |
| 5,332,528 | 7/1994 | Pan et al. | 252/548 |
| 5,374,716 | 12/1994 | Biermann et al. | 536/18.6 |
| 5,431,780 | 7/1995 | Raehse et al. | 159/48.1 |
| 5,454,982 | 10/1995 | Murch et al. | 252/548 |
| 5,500,150 | 3/1996 | Scheibel et al. | 252/544 |
| 5,510,049 | 4/1996 | Connor et al. | 252/108 |

FOREIGN PATENT DOCUMENTS

| | | |
|---|---|---|
| 014979 | 9/1980 | European Pat. Off. . |
| 018679 | 11/1980 | European Pat. Off. . |
| 114427 | 8/1984 | European Pat. Off. . |
| 114429 | 8/1984 | European Pat. Off. . |
| 122664 | 10/1984 | European Pat. Off. . |
| 167210 | 1/1986 | European Pat. Off. . |
| 184416 | 6/1986 | European Pat. Off. . |
| 206725 | 12/1986 | European Pat. Off. . |
| 268967 | 6/1988 | European Pat. Off. . |
| 301298 | 2/1989 | European Pat. Off. . |
| 619367 | 10/1994 | European Pat. Off. . |
| 4030688 | 4/1992 | Germany . |
| 1538857 | 1/1979 | United Kingdom . |
| WO 9003977 | 4/1990 | WIPO . |
| WO 9206984 | 4/1992 | WIPO . |
| WO 9319155 | 9/1993 | WIPO . |

OTHER PUBLICATIONS

Tens. Surf. Det. 25, 8 (1988) no month available.

ROEMPP Chemielexikon, 9, Aufl., Thieme–Verlag, Stuttgart, 1992, p. 4259/4260 no month available.

*Primary Examiner*—Paul Lieberman

*Assistant Examiner*—Necholus Ogden

*Attorney, Agent, or Firm*—Ernest G. Szoke; Wayne C. Jaeschke; Henry E. Millson, Jr.

[57] ABSTRACT

Detergent mixtures containing fatty alcohol sulfates, fatty alcohol ether sulfates, alkyl and/or alkenyl oligoglycosides and/or fatty acid N-alkyl polyhydroxyalkyl amides are eminently suitable in solid form for the production of toilet blocks.

16 Claims, No Drawings

USE OF DETERGENT MIXTURES FOR THE PRODUCTION OF TOILET BLOCKS

BACKGROUND OF THE INVENTION

1. Field of the Invention

This invention relates to the use of mixtures of selected anionic and nonionic surfactants for the production of toilet blocks.

2. Statement of Related Art

Prior Art

Toilet blocks are solid cleaning preparations which, by means of a fastening, can either be hung in the cistern or fixed below the inner rim of the toilet bowl. The function is to clean the surface of the toilet bowl during flushing and in particular to mask unpleasant odors by the release of fragrances. Surfactants, builders, inorganic salts and of course fragrances and dyes are normally used for their production.

Several formulations are known from the prior art. For example, U.S. Pat. No. 4,534,879 (Procter & Gamble) describes solid cleaning preparations containing $C_{9-15}$ alkyl sulfates, alkyl benzenesulfonates and water-insoluble inorganic salts as their surfactant component.

EP-A 0 014 979 (Henkel) describes toilet blocks containing alkyl benzenesulfonates, alkyl sulfates and olefin sulfonates as anionic surfactants and fatty alcohol or alkylphenol ethoxylates as nonionic surfactants.

Other toilet blocks based on anionic surfactants of sulfate and/or sulfonate structure are known, for example, from EP-A 018 679, EP-A 0 114 427, EP-A 0 114 429, EP-A 0 122 664, EP-A 0 167 210, EP-A 0 184 416 and EP-A 0 206 725.

EP-A 0 268 967 (Henkel) describes toilet blocks typically containing 22% of sodium lauryl sulfate, 12% of coconut oil fatty acid monoethanolamide, 2% of borax, 48% of sodium sulfate, 5% of sodium citrate, 6% of pine oil and 5% of dye.

It has now been found that the known products are not always satisfactory from the performance point of view. There is a particular interest above all in products having a slow dissolving rate, i.e. toilet blocks which will last for a greater of number of flushes. There is also a need for formulations which would have advantages in regard to processability (kneadability, dimensional stability, saturation tendency, etc.) and which would form a more stable foam.

Accordingly, the problem addressed by the invention was to provide such products.

DESCRIPTION OF THE INVENTION

The present invention relates to the use of detergent mixtures for the production of toilet blocks containing a) fatty alcohol sulfates corresponding to formula (I):

$$R^1O—SO_3X \quad (I)$$

in which $R^1$ is a linear or branched alkyl and/or alkenyl radical containing 6 to 18 carbon atoms and X is an alkali metal or alkaline earth metal, ammonium, alkyl ammonium, alkanolammonium or glucammonium, b) fatty alcohol ether sulfates corresponding to formula (II):

$$R^2O—(CH_2CH_2O)_mSO_3X \quad (II)$$

in which $R^2$ is a linear or branched alkyl and/or alkenyl radical containing 6 to 18 carbon atoms, m is a number of 1 to 10 and X is an alkali or alkaline earth metal, ammonium, alkyl ammonium, alkanolammonium or glucammonium, and c1) alkyl and/or alkenyl oligoglycosides corresponding to formula (III):

$$R^3—O—([G])_p \quad (III)$$

in which $R^3$ is an alkyl and/or alkenyl radical containing 6 to 22 carbon atoms, G is a sugar unit containing 5 or 6 carbon atoms and p is a number of 1 to 10, and/or C2) fatty acid N-alkyl polyhydroxyalkyl amides corresponding to formula (IV):

$$R^4CO—\overset{\overset{R^5}{|}}{N}—([Z]) \quad (IV)$$

in which $R^4CO$ is an aliphatic acyl radical containing 6 to 22 carbon atoms, $R^5$ is hydrogen, an alkyl or hydroxyalkyl radical containing 1 to 4 carbon atoms and ([Z]) is a linear or branched polyhydroxyalkyl radical containing 3 to 12 carbon atoms and 3 to 10 hydroxyl groups.

It has surprisingly been found that the use of the detergent mixtures in accordance with the invention leads to toilet blocks which are distinguished from commercial products by a longer life, i.e. a slower dissolving rate, improved foam and easier processability.

Fatty alcohol sulfates

Fatty alcohol sulfates, which are also known as alkyl sulfates, are known anionic surfactants which are preferably obtained by sulfation of native fatty alcohols or synthetic oxoalcohols and subsequent neutralization.

Typical examples of fatty alcohol sulfates which may be used as component a) are the sodium salts of sulfation products of caproic alcohol, caprylic alcohol, 2-ethylhexyl alcohol, capric alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol and erucyl alcohol and technical alcohol cuts obtained by hydrogenation of native fatty acid methyl ester fractions or of aldehydes from Roelen's oxo synthesis. Fatty alcohol sulfates containing 12 to 18 and in particular 12 to 14 carbon atoms are preferably used. Typical examples of such fatty alcohol sulfates are technical $C_{12/14}$ or $C_{12/18}$ coconut oil fatty alcohol sulfates in the form of their sodium salts.

Fatty alcohol ether sulfates

Fatty alcohol ether sulfates are also known industrial anionic surfactants which are obtained by sulfation of fatty alcohol ethoxylates and subsequent neutralization.

Typical examples of fatty alcohol ether sulfates which make up component b) are the sodium salts of sulfation products of the adducts of 1 to 10 and preferably 2 to 5 moles of ethylene oxide with caproic alcohol, caprylic alcohol, 2-ethylhexyl alcohol, capric alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, archyl alcohol, gadoleyl alcohol, behenyl alcohol and erucyl alcohol and the technical alcohol cuts obtained by hydrogenation of native fatty acid methyl ester fractions or aldehydes from Roelen's oxo synthesis. Fatty alcohol ether sulfates containing 12 to 18 and in particular 12 to 14 carbon atoms and having a degree of ethoxylation of 2 to 5 are preferably used. Typical examples are technical $C_{12/14}$ or $C_{12/18}$ coconut oil fatty alcohol ether sulfates in the form of their sodium salts which have a conventional or even narrow homolog distribution.

Alkyl and/or alkenyl oligoglycosides

Alkyl and alkenyl oligoglycosides are known substances which may be obtained by relevant methods of preparative organic chemistry. EP-A1-0 301 298 and WO 90/3977 are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (III) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization below 1.7 and, more particularly, between 1.2 and 1.4 are preferred from the applicational point of view.

The alkyl or alkenyl radical $R^3$ may be derived from primary alcohols containing 6 to 11 and preferably 8 to 10 carbon atoms. Typical examples are caproic alcohol, caprylic alcohol, capric alcohol and undecyl alcohol and technical mixtures thereof such as are obtained, for example, in the hydrogenation of technical fatty acid methyl esters or in the hydrogenation of aldehydes from Roelen's oxo synthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight $C_{12}$ alcohol as an impurity, and alkyl oligoglucosides based on technical $C_{9-11}$, oxoalcohols (DP=1 to 3) are preferred.

In addition, the alkyl or alkenyl radical $R^3$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and technical mixtures thereof which may be obtained as described above. Alkyl oligoglucosides based on hydrogenated $C_{12/14}$ coconut oil fatty alcohol having a DP of 1 to 3 are preferred.

Fatty acid N-alkyl polyhydroxyalkyl amides

The fatty acid N-alkyl polyhydroxyalkyl amides are also known substances which are normally obtained by reductive amination of a reducing sugar with ammonia, an alkyl amine or an alkanolamine and subsequent acylation with a fatty acid, a fatty acid alkyl ester or a fatty acid chloride. Processes for their production are described in U.S. Pat. No 1,985,424, U.S. Pat. No. 2,016,962 and U.S. Pat. No. 2,703,798 and in International patent application WO 92/06984. An overview on this subject by H. Kelkenberg can be found in Tens. Surf. Det. 25, 8 (1988).

The fatty acid N-alkyl polyhydroxyalkyl amides are preferably derived from reducing sugars containing 5 or 6 carbon atoms, more particularly glucose. Accordingly, the preferred fatty acid N-alkyl polyhydroxyalkyl amides are fatty acid N-alkyl glucamides corresponding to formula (V):

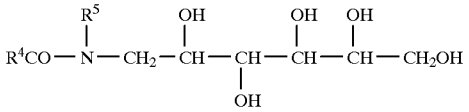

(V)

Glucamides corresponding to formula (V), in which $R^5$ is hydrogen or an amine group and $R^4CO$ is the acyl radical of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof, are preferably used as the fatty acid N-alkyl polyhydroxyalkyl amides. Fatty acid N-alkyl glucamides (V) obtained by reductive amination of glucose with methyl amine and subsequent acylation with lauric acid or $C_{12/14}$ coconut oil fatty acid or a corresponding derivative are particularly preferred. The polyhydroxyalkyl amides may also be derived from maltose and palatinose.

Fatty acid alkanolamides

The detergent mixtures may contain as further optional constituents fatty acid alkanolamides corresponding to formula (VI):

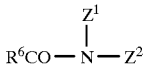

(VI)

in which $R^6CO$ is an aliphatic acyl radical containing 6 to 22 carbon atoms $Z^1$ is a hydroxyalkyl radical containing 2 to 4 carbon atoms and $Z^2$ has the same meaning as $Z^1$ or is hydrogen. These fatty acid alkanolamides are also known additives which are usually prepared by condensation of fatty acids with alkanolamines.

Typical examples are condensation products of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid and technical mixtures thereof with monoethanolamine and diethanolamine. Fatty acid alkanolamides corresponding to formula (VI), in which $R^6CO$ is a $C_{12-18}$ acyl radical, $Z^1$ is a hydroxyethyl radical and $Z^2$ has the same meaning as $Z^1$ or is hydrogen, are preferably used. It is particularly preferred to use $C_{12/14}$ or $C_{12/18}$ coconut oil fatty acid monoethanolamide or diethanolamide.

Fatty alcohol ethoxylates

The detergent mixtures according to the invention may contain as further optional components fatty alcohol ethoxylates corresponding to formula (VII):

$$R^7O—(CH_2CH_2O)_nH \quad (VII)$$

in which $R^7$ is a linear or branched alkyl and/or alkenyl radical containing 12 to 18 carbon atoms and n is a number of 20 to 50. These mixtures are also known industrial products which are usually prepared by base-catalyzed addition of ethylene oxide onto primary alcohols. Depending on the catalysts used (for example sodium methylate or calcined hydrotalcite), the ethoxylates may have a conventional or narrow homolog distribution.

Typical examples are adducts of 20 to 50 and preferably 25 to 40 moles of technical coconut oil fatty alcohols containing 12 to 18 and preferably 12 to 14 carbon atoms.

Composition of the detergent mixtures

The detergent mixtures to be used in accordance with the invention may have the following advantageous composition:

50 to 98% by weight of fatty alcohol sulfates, 1 to 15% by weight of fatty alcohol ether sulfates, 1 to 15% by weight of alkyl and/or alkenyl oligoglycosides and/or 1 to 15% by weight of fatty acid N-alkyl polyhydroxyalkyl amides.

The percentage content of the optional components corresponding to formulae (VI) and (VII) may be from 1 to 15% by weight and is preferably from 3 to 10% by weight, with the proviso that all the percentages add up to 100% by weight.

Production of dry formulations

The detergent mixtures according to the invention are preferably used in water-free form, for example in the form of powders, granules, extrudates or needles.

a) spray neutralization/spray drying.

Standard methods may be used for the production of the powders. For example, the acidic sulfation products of the fatty alcohols and fatty alcohol ethoxylates may be spray-neutralized together or separately and anhydrous glycosides and/or polyhydroxy fatty acid amides may be added to the dry powders. Aqueous mixtures of the components may also be prepared and spray-dried together. In addition, already dried powders of the individual components may be processed to the detergent mixtures, for example in Lödige blade mixer or in a Schugi spray mixer. Particulars of the spray drying and spray neutralization of surfactants can be found in ROEMPP Chemielexikon, 9th Edition, Thieme-Verlag, Stuttgart, 1992, pages 4259/4260.

b) Drying with Superheated steam "Drying with superheated steam" is a special spray-drying process carried out in the presence of superheated steam and in the absence of atmospheric oxygen. The principle of this new industrial process was disclosed by applicants in their German patent application DE-A 1 40 30 688.

The process is based on the principle whereby, through the condensation of the superheated steam on the cooler starting material and the release of the heat of condensation to the material to be dried, the water-containing droplets are spontaneously heated to the boiling temperature of the water under working conditions, i.e. under normal pressure to temperatures of around 100° C. This boiling temperature is maintained as a minimum temperature in the drops of material over the entire drying period. A desirable effect of drying the detergent mixtures to be used in accordance with the invention with superheated steam is that the dried material obtained has a large inner surface and can be dissolved or dispersed particularly easily in water.

Basically, the system used is a closed-loop in the form of a steam circuit from which the water evaporated from the starting material is removed while the energy released in particular during the drying step is returned to the circulating steam. Whereas, in conventional spray drying, operation at relatively high temperatures always involves the danger of partial carbonization of the material to be dried, the absence of atmospheric oxygen makes drying temperatures of 200 to 250° C. readily possible. After the removal of entrained particles of material, the steam removed may advantageously be put to another use as recycle steam.

c) SKET granulation

Another possibility is to subject the detergent mixtures to so-called SKET granulation. SKET granulation is a granulation process accompanied by drying which is preferably carried out in batches or continuously in a fluidized bed. The surfactants may be successively or simultaneously introduced into the fluidized bed through one or more nozzles, preferably in the form of water-containing pastes. Fluidized bed arrangements preferably used have base plates measuring 0.4 to 5 m. The SKET granulation is preferably carried out at fluidizing air flow rates of 1 to 8 m/s. The granules are preferably discharged from the fluidized bed via a grading stage. The granules may be graded, for example, by means of a sieve or by an air stream flowing in countercurrent (grading air) which is regulated in such a way that only particles beyond a certain size are removed from the fluidized bed while smaller particles are retained in the fluidized bed. The inflowing air is normally made up of the heated or unheated grading air and the heated "bottom" air. The bottom air temperature is between 80 and 400° C. and preferably between 90 and 350° C. A starting material, for example sodium sulfate or SKET granules from an earlier test batch, is advantageously introduced at the beginning of the SKET granulation process. In the fluidized bed, the water evaporates from the surfactant paste, resulting in the formation of partly dried or completely dried nuclei which become coated with further quantities of surfactant and are then granulated and dried at the same time.

d) Extrusion

In another preferred embodiment of the invention, the detergent mixtures are homogenized and compressed in a screw extruder. The mixtures are extruded through a perforated plate, resulting in the formation of extruded strands which may be mechanically size-reduced in known manner to form extrudates or needles of the required shape and size.

e) Structure breakers

Finally, the dry detergent mixtures may be mixed with hydrophobic structure breakers, for example an adduct of 3 moles of ethylene oxide with a $C_{12/14}$ coconut oil fatty alcohol, and then mechanically compacted. The liquid structure breaker is taken up by the dry powder and results in "marbelizing" of the surfactant particles. Products having a particularly large inner surface are obtained in this way, for example after granulation or extrusion. In addition, polyethylene glycols having molecular weights of 10,000 to 100,000 may be added to compact the particles.

Auxiliaries and additives

Auxiliaries and additives are understood to be the non-surface-active constituents of the formulations of commercial toilet blocks which are mixed with the detergent mixtures and subsequently brought into the required shape.

The detergent mixtures are generally used in water-free form. However, water may be added to them as an auxiliary in a quantity of 1 to 10% by weight and preferably in a quantity of 2 to 6% by weight, based on the mixture, to facilitate plasticization.

Other suitable auxiliaries and additives are inorganic salts, more particularly sodium sulfate, sodium carbonate and/or sodium chloride, which may make up from 25to 75% by weight and preferably from 30 to 60% by weight, based on the end product. One preferred embodiment is characterized by the use of detergent mixtures in the form of SKET granules which, for example, contain the necessary amount of sodium sulfate from their production.

Other suitable additives are solid or liquid builders, such as for example zeolite A, nitrilotriacetate, ethylenediamine tetraacetate or sodium citrate. They may make up from 5 to 15% by weight and preferably from 8 to 12% by weight of the end product. Finally, the toilet blocks generally contain dyes and fragrances, typically in quantities of 1 to 5% by weight, based on the end product.

Industrial Applications

The detergent mixtures according to the invention may be used as surfactant components for the production of toilet blocks. Products on this basis are distinguished by a slow dissolving rate, i.e. by a long useful life, by improved foam stability and by easier processability.

In the same way as a grated soap, the detergent mixtures may also be used for the production of preservative-free powders for handwashing pastes.

The following Examples are intended to illustrate the invention without limiting it in any way.

EXAMPLES

I. Formulations

TABLE 1

Formulations according to the invention and comparison formulations
Percentages as % of active substance
Fragrances and dyes ad % active substance

| | F1 % | F2 % | F3 % | F4 % | F5 % | F6 % |
|---|---|---|---|---|---|---|
| SULFOPON ® LS 35 | 25 | 25 | 25 | 25 | 25 | 25 |
| TEYAPON ® N 70 | 6 | 4 | 3 | 3 | 6 | 3 |
| PLANTAREN ® APG 600 | 6 | 4 | 3 | — | — | — |
| Glucamide | — | — | — | 3 | — | — |
| MARANIL ® A 55 | — | — | — | — | — | 3 |
| COMPERLAN ® 100 | — | 10 | 9 | 9 | 9 | 9 |
| DEHYDOL ® TA 25 | 6 | — | 3 | 3 | 3 | 3 |
| Sodium sulfate | 25 | 25 | 25 | 25 | 25 | 25 |
| Sodium chloride | 25 | 25 | 25 | 25 | 25 | 25 |
| Sodium citrate | 7 | 7 | 5 | 5 | 5 | 5 |

Legend: SULPOPON® LS 35: $C_{12/14}$ coconut oil fatty alcohol sulfate Na salt; TEXAPON® N 70: $C_{12/14}$ coconut oil fatty alcohol 2EO sulfate Na salt; PLANTAREN® APG 600: $C_{12/14}$ coconut oil alkyl oligoglucoside (DP=1.3); Glucamide: $C_{12/14}$ coconut oil fatty acid N-methyl glucamide; MARANIL® A55: dodecyl benzenesulfonate Na salt; COMPERLAN® 100: $C_{12/14}$ coconut oil fatty acid ethanolamide; DEHYDOL® TA 25: tallow alcohol 25EO adduct; all products of Henkel KGaA, Dusseldorf, Federal Republic of Germany.

II. Performance tests

Toilet blocks corresponding to formulations F1 to F4 according to the invention and comparison formulations F5 and F6 were evaluated according to the following criteria:

a) Processability (P): I (not very hard) to VI (extremely hard)

b) Cohesion of the compound (C): I (very easy to mold) to VI (almost impossible to mold)

c) useful life (number of flushes, U)

d) Basic foam of the detergent mixture ($F^0$) and foam height after 20 minutes ($F^{20}$)—foam generation method according to DIN 53 902-II.

The results are set out in Table 2 below:

TABLE 2

| | | Performance tests | | | | |
|---|---|---|---|---|---|---|
| Ex. | Formulation | P | C | U | $F^0$ ml | $F^{20}$ ml |
| 1 | F1 | II | II | 530 | 110 | 90 |
| 2 | F2 | II | I | 520 | 110 | 90 |
| 3 | F3 | I | I | 550 | 110 | 90 |
| 4 | F4 | I | II | 525 | 110 | 95 |
| C1 | F5 | III | II | 278 | 50 | 20 |
| C2 | F6 | VI | V | 212 | 80 | 70 |

We claim:

1. A solid toilet freshening block comprising a mixture of the following surfactants:

A) from about 50 to about 95% by weight of at least one fatty alcohol sulfate of the formula:

$$R^1O—SO_3X \quad (I)$$

in which $R^1$ is a linear or branched alkyl or alkenyl radical containing 6 to 18 carbon atoms and X is an alkali metal or alkaline earth metal, ammonium, alkyl ammonium, alkanolammonium, or glucammonium ion;

B) from about 1 to about 15% by weight of at least one fatty alcohol ether sulfate of the formula:

$$R^2O—(CH_2CH_2O)_mSO_3 \quad (II)$$

in which $R^2$ is a linear or branched alkyl or alkenyl radical containing 6 to 18 carbon atoms, m is a number of 1 to 10 and X is an alkali or alkaline earth metal, ammonium, alkyl ammonium, alkanolammonium, or glucammonium ion; and C) one or more surfactants selected from either or both of the following:

i) from about 1 to about 15% by weight of an alkyl or alkenyl oligoglycoside of the formula:

$$R^3—O—(G)_p \quad (III)$$

in which $R^3$ is an alkyl or alkenyl radical containing 6 to 22 carbon atoms, G is a sugar unit containing 5 or 6 carbon atoms and p is a number of 1 to 10, ii) from about 1 to about 15% by weight of a fatty acid N-alkyl polyhydroxyalkyl amide of the formula:

$$R^4CO—\overset{\overset{R^5}{|}}{N}—(Z) \quad (IV)$$

in which $R^4CO$ is an aliphatic acyl radical containing 6 to 22 carbon atoms, $R^5$ is hydrogen or an alkyl or hydroxyalkyl radical containing 1 to 4 carbon atoms and (Z) is a linear or branched polyhydroxyalkyl radical containing 3 to 12 carbon atoms and 3 to 10 hydroxyl groups.

2. The toilet block of claim 1 wherein the composition also comprises at least one of the following:

D) a fatty acid alkanolamide of the formula:

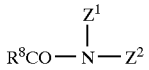

(VI)

in which $R^6CO$ is an aliphatic acyl radical containing 6 to 22 carbon atoms, $Z^1$ is a hydroxyalkylene radical containing 2 to 4 carbon atoms and $Z^2$ has the same meaning as $Z^1$ or is hydrogen;

E) a fatty alcohol ethoxylate of the formula:

$$R^7O—(CH_2CH_2O)_nH \quad (VII)$$

in which $R^7$ is a linear or branched alkyl or alkenyl radical containing 12 to 18 carbon atoms and n is a number of 20 to 50.

3. The toilet block of claim 1 wherein in component A) $R^1$ contains from 12 to 18 carbon atoms.

4. The toilet block of claim 3 wherein $R^1$ contains from 12 to 14 carbon atoms.

5. The toilet block of claim 1 wherein in component B) $R^2$ contains from 12 to 18 carbon atoms.

6. The toilet block of claim 5 wherein $R^2$ contains from 12 to 14 carbon atoms.

7. The toilet block of claim 5 wherein in component B) m is a number of from 2 to 5.

8. The toilet block of claim 1 wherein in component C) i) p is a number of from 1.1 to 3.0.

9. The toilet block of claim 1 wherein in component C) i) $R^3$ is a primary alkyl or alkenyl group containing from 6 to 11 carbon atoms.

10. The toilet block of claim 8 wherein $R^3$ is a primary alkyl or alkenyl group containing from 6 to 11 carbon atoms.

11. The toilet block of claim 8 wherein $R^3$ is a primary alkyl or alkenyl group containing from 12 to 22 carbon atoms.

12. The toilet block of claim 1 wherein component C) ii) has the formula:

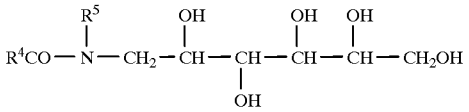

(V)

in which $R^5$ is hydrogen or an amine group and $R^4CO$ is the acyl radical of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid, or erucic acid, or technical mixtures thereof.

13. The toilet block of claim 1 which also contains at least one of

F) an inorganic salt which is at least one of sodium sulfate, sodium carbonate, and sodium chloride;

G) a solid or liquid builder;

H) a dye and/or a fragrance.

14. The toilet block of claim 1 wherein in component A) $R^1$ contains from 12 to 18 carbon atoms; in component B) $R^2$ contains from 12 to 18 carbon atoms; and in component C) i) p is a number of from 1.1 to 3.0, and $R^3$ is a primary alkyl or alkenyl group.

15. The toilet block of claim 14 wherein $R^1$ and $R^2$ both contain from 12 to 14 carbon atoms.

16. The toilet block of claim 1 wherein in component A) $R^1$ contains from 12 to 18 carbon atoms; in component B) $R^2$ contains from 12 to 18 carbon atoms; and component C) ii) has the formula:

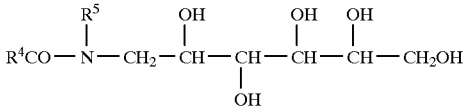

(V)

in which $R^5$ is hydrogen or an amine group and $R^4CO$ is the acyl radical of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid, or erucic acid, or technical mixtures thereof.

* * * * *